US007375257B2

(12) United States Patent
Dath et al.

(10) Patent No.: US 7,375,257 B2
(45) Date of Patent: May 20, 2008

(54) PROCESS FOR CRACKING AN OLEFIN-RICH HYDROCARBON FEEDSTOCK

(75) Inventors: Jean-Pierre Dath, Beloeil (BE); Walter Vermeiren, Houthalem-Helchterem (BE)

(73) Assignee: Total Petrochemicals Research Feluy, Feluy (BE)

( * ) Notice: Subject to any disclaimer, the term of this patent is extended or adjusted under 35 U.S.C. 154(b) by 231 days.

(21) Appl. No.: 10/398,603

(22) PCT Filed: Oct. 3, 2001

(86) PCT No.: PCT/EP01/11487

§ 371 (c)(1),
(2), (4) Date: Jan. 23, 2004

(87) PCT Pub. No.: WO02/28987

PCT Pub. Date: Apr. 11, 2002

(65) Prior Publication Data

US 2005/0096492 A1 May 5, 2005

(30) Foreign Application Priority Data

Oct. 5, 2000 (EP) ..... 00 121 727

(51) Int. Cl.
*C07C 4/02* (2006.01)
*C10G 11/02* (2006.01)

(52) U.S. Cl. ..... 585/653; 585/648; 208/113; 208/118; 208/120.01

(58) Field of Classification Search ..... 585/648, 585/653; 208/113, 118, 120.01
See application file for complete search history.

(56) References Cited

U.S. PATENT DOCUMENTS 4,922,051 A * 5/1990 Nemet-Mavrodin et al. ..... 585/418

(Continued)

FOREIGN PATENT DOCUMENTS

EP 0385538 A1 9/1990

FOREIGN PATENT DOCUMENTS

EP 0921179 A1 6/1999

*Primary Examiner*—Glenn Caldarola
*Assistant Examiner*—In Suk Bullock
(74) *Attorney, Agent, or Firm*—Shirley A. Kopecky; William D. Jackson

(57) ABSTRACT

A process for cracking an olefin containing hydrocarbon feedstock which is selective towards light olefins in the effluent, the process comprising passing a hydrocarbon feedstock containing one or more olefins through a moving bed reactor containing a crystalline silicate catalyst selected from an MFI-type crystalline silicate having a silicon/aluminium atomic ratio of at least 180 and an MEL-type crystalline silicate having a silicon/aluminium atomic ration of from 150 to 800 which has been subjected to a steaming step, at an inlet temperature of from 500 to 600° C., at an olefin partial pressure of from 0.1 to 2 bars and the feedstock being passed over the catalyst at an LHSV of from 5 to 30 $h^{-1}$ to produce an effluent with an olefin content of lower molecular weight than that of the feedstock, intermittently removing a first fraction of the catalyst from the moving bed reactor, regenerating the first fraction of the catalyst in a regenerator and intermittently feeding into the moving bed reactor a second fraction of the catalyst which has been regenerated in the regenerator, the catalyst regeneration rate being controlled whereby the propylene purity is maintained constant at a value corresponding to the average value observed in a fixed bed reactor using the same feedstock, catalyst and cracking conditions, for example at least 94 wt. %.

24 Claims, 5 Drawing Sheets

U.S. PATENT DOCUMENTS 4,927,526 A 5/1990 Anderson et al.
4,980,053 A 12/1990 Li et al.
4,994,173 A 2/1991 Tai-Sheng et al.
6,410,813 B1 * 6/2002 Dath et al. ..... 585/653
6,548,725 B2 * 4/2003 Froment et al. ..... 585/653
6,646,175 B1 * 11/2003 Dath et al. ..... 585/651
6,646,176 B1 * 11/2003 Dath et al. ..... 585/651
6,977,321 B1 * 12/2005Dath et al. ..... 585/653

* cited by examiner

PROCESS FOR CRACKING AN OLEFIN-RICH HYDROCARBON FEEDSTOCK

The present invention relates to a process for cracking an olefin-rich hydrocarbon feedstock which is selective towards light olefins in the effluent. In particular, olefinic feedstocks from refineries or petrochemical plants can be converted selectively so as to redistribute the olefin content of the feedstock in the resultant effluent.

It is known in the art to use zeolites to convert long chain paraffins into lighter products, for example in the catalytic de-waxing of petroleum feedstocks. While it is not the objective of de-waxing, at least parts of the paraffinic hydrocarbons are converted into olefins. It is known in such processes to use crystalline silicates for example of the MFI or MEL type, the three-letter designations "MFI" and "MEL" each representing a particular crystalline silicate structure type as established by the Structure Commission of the International Zeolite Association. Examples of a crystalline silicate of the MFI type are the synthetic zeolite ZSM-5 and silicalite and other MFI type crystalline silicates are known in the art. An example of a crystalline silicate of the MEL type is the synthetic zeolite ZSM-11.

EP-A-0305720 discloses the production of gaseous olefins by catalytic conversion of hydrocarbons. EP-B-0347003 discloses a process for the conversion of a hydrocarbonaceous feedstock into light olefins. WO-A-90/11338 discloses a process for the conversion of $C_2$-$C_{12}$ paraffinic hydrocarbons to petrochemical feedstocks, in particular to $C_2$ to $C_4$ olefins. U.S. Pat. No. 5,043,522 and EP-A-0395345 disclose the production of olefins from paraffins having four or more carbon atoms. EP-A-0511013 discloses the production of olefins from hydrocarbons using a steam activated catalyst containing phosphorous and H-ZSM-5. U.S. Pat. No. 4,810,356 discloses a process for the treatment of gas oils by de-waxing over a silicalite catalyst. GB-A-2156845 discloses the production of isobutylene from propylene or a mixture of hydrocarbons containing propylene. GB-A-2159833 discloses the production of a isobutylene by the catalytic cracking of light distillates.

It is known in the art that for the crystalline silicates exemplified above, long chain olefins tend to crack at a much higher rate than the corresponding long chain paraffins.

It is further known that when crystalline silicates are employed as catalysts for the conversion of paraffins into olefins, such conversion is not stable against time. The conversion rate decreases as the time on stream increases, which is due to formation of coke (carbon) which is deposited on the catalyst.

These known processes are employed to crack heavy paraffinic molecules into lighter molecules. However, when it is desired to produce propylene, not only are the yields low but also the stability of the crystalline silicate catalyst is low. For example, in an FCC unit a typical propylene output is 3.5 wt %. The propylene output may be increased to up to about 7-8 wt % propylene from the FCC unit by introducing the known ZSM-5 catalyst into the FCC unit to "squeeze" out more propylene from the incoming hydrocarbon feedstock being cracked. Not only is this increase in yield quite small, but also the ZSM-5 catalyst has low stability in the FCC unit.

There is an increasing demand for propylene in particular for the manufacture of polypropylene.

The petrochemical industry is presently facing a major squeeze in propylene availability as a result of the growth in propylene derivatives, especially polypropylene. Traditional methods to increase propylene production are not entirely satisfactory. For example, additional naphtha steam cracking units which produce about twice as much ethylene as propylene are an expensive way to yield propylene since the feedstock is valuable and the capital investment is very high. Naphtha is in competition as a feedstock for steam crackers because it is a base for the production of gasoline in the refinery. Propane dehydrogenation gives a high yield of propylene but the feedstock (propane) is only cost effective during limited periods of the year, making the process expensive and limiting the production of propylene. Propylene is obtained from FCC units but at a relatively low yield and increasing the yield has proven to be expensive and limited. Yet another route known as metathesis or disproportionation enables the production of propylene from ethylene and butene. Often, combined with a steam cracker, this technology is expensive since it uses ethylene as a feedstock which is at least as valuable as propylene.

Thus there is a need for a high yield propylene production method which can readily be integrated into a refinery or petrochemical plant, taking advantage of feedstocks that are less valuable for the market place (having few alternatives on the market).

EP-A-0921179 in the name of Fina Research S.A. discloses the production of olefins by catalytic cracking of an olefin-rich hydrocarbon feedstock which is selective towards light olefins in the effluent. While it is disclosed in that document that the catalyst has good stability, i.e. high activity over time, and a stable olefin conversion and a stable product distribution over time, nevertheless the catalyst stability still requires improvement, particularly when higher inlet temperature within the broad range disclosed (500 to 600° C.) are employed in conjunction with a single reactor. That specification exemplifies the use of a fixed bed reactor, although it is disclosed that a moving bed reactor, of the continuous catalytic reforming type, or a fluidised bed reactor may be employed for the olefin-cracking process.

During hydrocarbon conversion reactions, a carbonaceous material, i.e., coke, can be formed and deposited on a catalyst thereby causing it to lose activity. The deposited carbonaceous material on the catalyst affects the amount of active catalyst centres on the catalyst and thereby influences the extent of the hydrocarbon conversion reaction, and hence the conversion to desired products and by-products. The presence of carbonaceous material on the catalyst results in a changing product distribution that affects the downstream fractionation section and the recycle rate of unconverted hydrocarbon feed. For most hydrocarbons conversion process the loss of activity can be compensated by increasing the reaction temperature up to a value where undesirable side reactions become important or up to a value which becomes impracticable.

Thus, it is further known in hydrocarbon conversion processes partially to regenerate a catalyst using a moving bed reactor. U.S. Pat. No. 3,838,039 discloses a method of operating a continuous hydrocarbon process employing catalyst particles in which catalyst activity is maintained by continuous regeneration. EP-A-0273592 discloses a process for continuous de-waxing of hydrocarbon oils including reactivation of partially spent catalyst. U.S. Pat. No. 5,157,181 discloses a moving bed hydrocarbon conversion process incorporating partial regeneration of a co-catalyst. U.S. Pat. No. 3,978,150 discloses a continuous paraffin dehydrogenation process incorporating partial catalyst regeneration. U.S. Pat. No. 5,336,829 discloses a continuous process for the dehydrogenation of paraffinic to olefinic hydrocarbons incorporating catalyst regeneration. U.S. Pat. No. 5,370,786 discloses a method of operating a continuous conversion process employing solid catalyst particles in which the catalyst may be regenerated. U.S. Pat. No. 4,973,780 discloses the alkylation of benzene in a moving bed incorporating partial catalyst regeneration. U.S. Pat. No. 5,849,976 discloses a moving bed solid catalyst hydrocarbon alkylation process incorporating partial catalyst regeneration. U.S. Pat. No. 5,087,783 discloses the transalkylation of benzene in a moving bed, incorporating partial catalyst reactivation. EP-A-0385538 discloses a process for the conversion of a straight-run hydrocarbonaceous feedstock containing hydrocarbons having such a boiling range that an amount thereof boils at a temperature of at least 330° C., such as a gas oil, in a moving bed reactor which may incorporate catalyst regeneration of the zeolite catalyst. EP-A-0167325 discloses a process for changeover of a moving bed catalytic cracking unit's catalyst inventory from conventional catalyst to ZSM-5 containing catalyst, the feedstock comprising an oil changestock for example a blend of crude oils or a gas oil fraction. U.S. Pat. No. 4,927,526 discloses a process for catalytically cracking hydrocarbon feedstock in a cracking unit to a product comprising gasoline with an increased octane number in the presence of a cracking catalyst, under cracking conditions. The process may employ moving bed catalytic cracking, with changeover of the catalyst inventory.

While the use of a moving bed employing partial catalyst regeneration or reactivation has been known in the art for some time, this, to the applicant's knowledge, has not been disclosed heretofore for use in an olefin-cracking process.

The olefin-cracking process as disclosed in EP-A-0921179 may be carried out at high reaction temperature close to the temperature of thermal cracking of hydrocarbon molecules. However, raising the reaction temperature in order to compensate the loss of catalytic activity in the olefin-cracking process is limited, as it will favour undesirable side reactions that are not the result of the presence of the catalyst. Moreover, the surface temperatures required to heat up the feed mixture in for instance a fire heater can become so high that thermal cracking of the feed starts.

When the olefin-cracking process of EP-A-0921179 is applied in a fixed bed reactor, it is observed that at the start of the catalytic cycle small amounts of less desired products like propane are produced. This results in a lower propylene purity of the C3 fraction. Moreover, the ethylene production rate is higher at the start of the catalytic cycle than after some time. The amount of the less desired product, propane, decreases during the operation and also the ethylene product decreases. During an important period of time the propylene yield remains fairly constant while those of propane and ethylene progressively decreases. These variations during the use of the catalyst in a fixed bed reactor are the result of a changing performance of the catalyst caused by the carbonaceous material laydown.

It is an object of the present invention to provide a process for using the less valuable olefins present in refinery and petrochemical plants as a feedstock for a process which, in contrast to the prior art processes referred to above, catalytically converts olefins into lighter olefins, and in particular propylene, and which process has improved catalyst stability.

It is another object of the invention to provide a process for producing olefins having a high propylene yield and purity, most particularly substantially constantly over the whole time of the process.

The present invention provides a process for cracking an olefin-containing hydrocarbon feedstock which is selective towards light olefins in the effluent, the process comprising passing a hydrocarbon feedstock containing one or more olefins through a moving bed reactor containing a crystalline silicate catalyst selected from an MFI-type crystalline silicate having a silicon/aluminium atomic ratio of at least 180 and an MEL-type crystalline silicate having a silicon/aluminium atomic ratio of from 150 to 800 which has been subjected to a steaming step, at an inlet temperature of from 500 to 600° C., at an olefin partial pressure of from 0.1 to 2 bars and the feedstock being passed over the catalyst at an LHSV of from 5 to 30 $h^{-1}$ to produce an effluent with an olefin content of lower molecular weight than that of the feedstock, intermittently removing a first fraction of the catalyst from the moving bed reactor, regenerating the first fraction of the catalyst in a regenerator and intermittently feeding into the moving bed reactor a second fraction of the catalyst which has been regenerated in the regenerator, the catalyst regeneration rate being controlled whereby the propylene purity is maintained constant at a value corresponding to the average value observed in a fixed bed reactor using the same feedstock, catalyst and cracking conditions, for example at least 94 wt %.

Preferably, the catalyst regeneration rate is controlled whereby the ethylene yield on an olefin basis is less than 10 wt %.

The present invention further provides a process for cracking an olefin-containing hydrocarbon feedstock which is selective towards light olefins in the effluent, the process comprising passing a hydrocarbon feedstock containing one or more olefins through a moving bed reactor containing a crystalline silicate catalyst selected from an MFI-type crystalline silicate having a silicon/aluminium atomic ratio of at least 180 and an MEL-type crystalline silicate having a silicon/aluminium atomic ratio of from 150 to 800 which has been subjected to a steaming step, at an inlet temperature of from 500 to 600° C., at an olefin partial pressure of from 0.1 to 2 bars and the feedstock being passed over the catalyst at an LHSV of from 5 to 30 $h^{-1}$ to produce an effluent with an olefin content of lower molecular weight than that of the feedstock, intermittently removing a first fraction of the catalyst from the moving bed reactor, regenerating the first fraction of the catalyst in a regenerator and intermittently feeding into the moving bed reactor a second fraction of the catalyst which has been regenerated in the regenerator, the catalyst regeneration rate being controlled whereby all of the catalyst in the moving bed reactor is regenerated in a period of from 20 to 240 hours.

Preferably, the regeneration rate is controlled whereby the propylene purity is maintained constant at a value corresponding to the average value obtained in a fixed bed reactor using the same feedstock, catalyst and cracking conditions, for example at least 94 wt %.

More preferably, the regeneration rate is controlled whereby the ethylene yield on an olefin basis is less than 10 wt %.

The present invention still further provides the use of catalyst regeneration of a moving bed reactor for the catalytic cracking of an olefin-containing feedstock which is selective towards lighter olefins, the catalyst regeneration being employed to average out propylene purity to higher values observed in a fixed bed reaction during an initial period, typically from 10 to 40 hours, of the olefin-cracking process.

Preferably, the catalyst regeneration is also employed to average out the high ethylene yield during the initial period and the low ethylene yield during the final period observed in a fixed bed reactor.

The feedstock having at least $C_4$+ hydrocarbons may be an effluent from a fluidised bed catalytic cracking (FCC) unit in an oil refinery.

The present invention provides a solution to the problem of loss of activity of the catalyst by the addition of the steps of removing deactivated catalyst from, and feeding reactivated catalyst into, the catalytic conversion zone which compensates for loss of activity without raising the reaction temperature, in particular, by using a moving bed reactor in which the catalyst circulates between a catalytic conversion zone and a catalyst regeneration zone. A moving bed reactor/regeneration combination still provides the possibility to operate the reaction section and regeneration section independently as they are physically isolated by means of lock hoppers and valves between the different sections. Each section can thus operate at its own optimal conditions and moreover the regeneration section can be temporarily shut down while the reaction section continues to operate.

When employing a moving bed reactor in which intermittently catalyst is withdrawn and regenerated and consequently re-injected into the catalytic reaction zone, the catalytic performance of the catalyst in the catalytic reaction zone can be maintained constant. This will result in a constant product distribution over time. Moreover, the less desired product formation, observed at the start of the catalytic cycle in fixed bed reactors, can thus be moderated because the catalytic performance in a moving bed reactor is an average of the catalytic performance observed in fixed bed reactors.

The present invention is predicated on the discovery by the inventor that in order to achieve a propylene purity i.e. a proportion of propylene in the total $C_3$ content of the effluent, of at least 94 wt %, and preferably also to achieve an ethylene yield on an olefin basis below 10 wt %, then the use of a moving bed reactor with catalyst regeneration enables these average values to be achieved on a continuous basis, more particularly by regulating the catalyst regeneration according to the desired propylene purity, and optionally depending on the ethylene content, which is dependent upon the particular commercial requirements for the proportion of ethylene in the effluent, whereby the entire catalyst content of the moving bed reactor is regenerated in a period of from 20 to 240 hours. The particular period within which the entire body of catalyst in the moving bed reactor is regenerated depends on a number of factors, including the nature of the particular catalyst, temperature, LHSV, feedstock content, etc. Fundamentally, the catalyst regeneration is carried out so that the average values of propylene purity, and preferably also ethylene yield on an olefin basis, are such as to enable high purity propylene to be produced, with the averaging essentially overcoming the technical problem of low propylene purity and optionally high ethylene yield on an olefin basis during the initial period of a fixed bed reactor, typically up to the first 10 to 40 e.g. 20 or 30 hours, of the olefin cracking process. This overcomes the technical problem present in the prior art, in particular in EP-A-0921179, of low propylene purity, and optionally also high ethylene yield on an olefin basis, reducing the ability of the catalyst to produce acceptable chemical grade purity propylene, and optionally low ethylene content, over acceptable run times.

The preferred embodiment of the present invention can thus provide a process using a catalyst for the production of a catalytic reactor effluent characterised by a constant composition by utilising a moving bed reactor in which the catalyst circulates between a catalytic conversion zone and a catalyst regeneration zone. The preferred embodiments of the present invention can also provide a process using a catalyst whereby the formation of less desired products over fresh catalyst is tempered to an average acceptable level by utilising a moving bed reactor in which the catalyst circulates between a catalytic conversion zone and a catalyst regeneration zone.

The present invention can thus provide a process wherein olefin-rich hydrocarbon streams (products) from refinery and petrochemical plants are selectively cracked not only into light olefins, but particularly into propylene. In one embodiment, the olefin-rich feedstock is passed over an MFI-type crystalline silicate catalyst with a particular Si/Al atomic ratio of either at least 180 attained after a steaming/de-alumination treatment or at least 300 with the catalyst having been prepared by crystallisation using an organic template and having been unsubjected to any subsequent steaming or de-alumination process. In another embodiment, the olefin-rich feedstock is passed over an MEL-type crystalline silicate catalyst, with a particular Si/Al atomic ratio and which has been steamed for example at a temperature of at least 300° C. for a period of at least 1 hour with a water partial pressure of at least 10 kPa. The feedstock may be passed over the catalyst at a temperature ranging between 500 to 600° C., an olefin partial pressure of from 0.1 to 2 bars and an LHSV of from 5 to 30 $h^{-1}$. This can yield at least 30 to 50% propylene based on the olefin content in the feedstock, with a selectivity to propylene for the $C_3$ species propylene and propane (i.e. a $C_3^{=}/C_3$s ratio) of at least 92% by weight.

In this specification, the term "silicon/aluminium atomic ratio" is intended to mean the Si/Al atomic ratio of the overall material, which may be determined by chemical analysis. In particular, for crystalline silicate materials, the stated Si/Al ratios apply not just to the Si/Al framework of the crystalline silicate but rather to the whole material.

The feedstock may be fed either undiluted or diluted with an inert gas such as nitrogen. In the latter case, the absolute pressure of the feedstock constitutes the partial pressure of the hydrocarbon feedstock in the inert gas.

In accordance with the present invention, cracking of olefins is performed in the sense that olefins in a hydrocarbon stream are cracked into lighter olefins and selectively into propylene. The feedstock and effluent preferably have substantially the same olefin content by weight. Typically, the olefin content of the effluent is within ±15 wt %, more preferably ±10 wt %, of the olefin content of the feedstock. The feedstock may comprise any kind of olefin-containing hydrocarbon stream. The feedstock may typically comprise from 10 to 100 wt % olefins and furthermore may be fed undiluted or diluted by a diluent, the diluent optionally including a non-olefinic hydrocarbon. In particular, the olefin-containing feedstock may be a hydrocarbon mixture containing normal and branched olefins in the carbon range $C_4$ to $C_{10}$, more preferably in the carbon range $C_4$ to $C_6$, optionally in a mixture with normal and branched paraffins and/or aromatics in the carbon range $C_4$ to $C_{10}$. Typically, the olefin-containing stream has a boiling point of from around −15 to around 180° C.

In particularly preferred embodiments of the present invention, the hydrocarbon feedstocks comprise $C_4$ mixtures from refineries and steam cracking units. Such steam cracking units crack a wide variety of feedstocks, including ethane, propane, butane, naphtha, gas oil, fuel oil, etc. Most particularly, the hydrocarbon feedstock may comprises a $C_4$ cut from a fluidised-bed catalytic cracking (FCC) unit in a crude oil refinery which is employed for converting heavy oil into gasoline and lighter products. Typically, such a $C_4$ cut from an FCC unit comprises around 50 wt % olefin.

Alternatively, the hydrocarbon feedstock may comprise a $C_4$ cut from a unit within a crude oil refinery for producing methyl tert-butyl ether (MTBE) which is prepared from methanol and isobutene. Again, such a $C_4$ cut from the MTBE unit typically comprises around 50 wt % olefin. These $C_4$ cuts are fractionated at the outlet of the respective FCC or MTBE unit. The hydrocarbon feedstock may yet further comprise a $C_4$ cut from a naphtha steam-cracking unit of a petrochemical plant in which naphtha, comprising $C_5$ to $C_9$ species having a boiling point range of from about 15 to 180° C., is steam cracked to produce, inter alia, a $C_4$ cut. Such a $C_4$ cut typically comprises, by weight, 40 to 50% 1,3-butadiene, around 25% isobutylene, around 15% butene (in the form of but-1-ene and/or but-2-ene) and around 10% n-butane and/or isobutane. The olefin-containing hydrocarbon feedstock may also comprise a $C_4$ cut from a steam cracking unit after butadiene extraction (Raffinate 1), or after butadiene hydrogenation.

In accordance with the present invention, the catalyst for the cracking of the olefins comprises a crystalline silicate of the MFI family which may be a zeolite, a silicalite or any other silicate in that family or the MEL family which may be a zeolite or any other silicate in that family. Examples of MFI silicates are ZSM-5 and silicalite. An example of an MEL zeolite is ZSM-11 which is known in the art. Other examples are Boralite D, and silicalite-2 as described by the International Zeolite Association (Atlas of zeolite structure types, 1987, Butterworths).

The preferred crystalline silicates have pores or channels defined by ten oxygen rings and a high silicon/aluminium atomic ratio.

Crystalline silicates are microporous crystalline inorganic polymers based on a framework of $XO_4$ tetrahydra linked to each other by sharing of oxygen ions, where X may be trivalent (e.g. Al, B, . . . ) or tetravalent (e.g. Ge, Si, . . . ). The crystal structure of a crystalline silicate is defined by the specific order in which a network of tetrahedral units are linked together. The size of the crystalline silicate pore openings is determined by the number of tetrahedral units, or, alternatively, oxygen atoms, required to form the pores and the nature of the cations that are present in the pores. They possess a unique combination of the following properties: high internal surface area; uniform pores with one or more discrete sizes; ion exchangeability; good thermal stability; and ability to adsorb organic compounds. Since the pores of these crystalline silicates are similar in size to many organic molecules of practical interest, they control the ingress and egress of reactants and products, resulting in particular selectivity in catalytic reactions. Crystalline silicates with the MFI structure possess a bi-directional intersecting pore system with the following pore diameters: a straight channel along [10]: 0.53-0.56 nm and a sinusoidal channel along [100]: 0.51-0.55 nm. Crystalline silicates with the MEL structure possess a bi-directional intersecting straight pore system with straight channels along [100] having pore diameters of 0.53-0.54 nm.

The crystalline silicate catalyst has structural and chemical properties and is employed under particular reaction conditions whereby the catalytic cracking readily proceeds. Different reaction pathways can occur on the catalyst. Under the process conditions, having an inlet temperature of around 500 to 600° C., preferably from 520 to 600° C., yet more preferably 540 to 580° C., and an olefin partial pressure of from 0.1 to 2 bars, most preferably around atmospheric pressure, the shift of the double bond of an olefin in the feedstock is readily achieved, leading to double bond isomerisation. Furthermore, such isomerisation tends to reach a thermodynamic equilibrium. Propylene can be, for example, directly produced by the catalytic cracking of hexene or a heavier olefinic feedstock. Olefinic catalytic cracking may be understood to comprise a process yielding shorter molecules via bond breakage.

With such high silicon/aluminum ratio in the crystalline silicate catalyst, a stable olefin conversion can be achieved with a high propylene yield on an olefin basis of from 30 to 50% whatever the origin and composition of the olefinic feedstock. Such high ratios reduce the acidity of the catalyst, thereby increasing the stability of the catalyst.

The MFI catalyst having a high silicon/aluminum atomic ratio for use in the catalytic cracking process of the present invention may be manufactured by removing aluminum from a commercially available crystalline silicate. A typical commercially available silicalite has a silicon/aluminum atomic ratio of around 120. The commercially available MFI crystalline silicate may be modified by a steaming process which reduces the tetrahedral aluminum in the crystalline silicate framework and converts the aluminum atoms into octahedral aluminum in the form of amorphous alumina. Although in the steaming step aluminum atoms are chemically removed from the crystalline silicate framework structure to form alumina particles, those particles cause partial obstruction of the pores or channels in the framework. This inhibits the olefinic cracking processes of the present invention. Accordingly, following the steaming step, the crystalline silicate is subjected to an extraction step wherein amorphous alumina is removed from the pores and the micropore volume is, at least partially, recovered. The physical removal, by a leaching step, of the amorphous alumina from the pores by the formation of a water-soluble aluminum complex yields the overall effect of de-alumination of the MFI crystalline silicate. In this way by removing aluminum from the MFI crystalline silicate framework and then removing alumina formed therefrom from the pores, the process aims at achieving a substantially homogeneous de-alumination throughout the whole pore surfaces of the catalyst. This reduces the acidity of the catalyst, and thereby reduces the occurrence of hydrogen transfer reactions in the cracking process. The reduction of acidity ideally occurs substantially homogeneously throughout the pores defined in the crystalline silicate framework. This is because in the olefin-cracking process hydrocarbon species can enter deeply into the pores. Accordingly, the reduction of acidity and thus the reduction in hydrogen transfer reactions which would reduce the stability of the MFI catalyst are pursued throughout the whole pore structure in the framework. The framework silicon/aluminum ratio may be increased by this process to a value of at least about 180, preferably from about 180 to 1000, more preferably at least 200, yet more preferably at least 300, and most preferably around 480.

The MEL or MFI crystalline silicate catalyst may be mixed with a binder, preferably an inorganic binder, and shaped to a desired shape, e.g. extruded pellets. The binder is selected so as to be resistant to the temperature and other conditions employed in the catalyst manufacturing process and in the subsequent catalytic cracking process for the olefins. The binder is an inorganic material selected from clays, silica, metal oxides such as $ZrO_2$ and/or metals, or gels including mixtures of silica and metal oxides. The binder is preferably alumina-free. Although aluminium in certain chemical compounds as in $AlPO_4$'s may be used as the latter are quite inert and not acidic in nature. If the binder which is used in conjunction with the crystalline silicate is itself catalytically active, this may alter the conversion and/or the selectivity of the catalyst. Inactive materials for the binder may suitably serve as diluents to control the amount of conversion so that products can be obtained economically and orderly without employing other means for controlling the reaction rate. It is desirable to provide a catalyst having a good crush strength. This is because in commercial use, it is desirable to prevent the catalyst from breaking down into powder-like materials. Such clay or oxide binders have been employed normally only for the purpose of improving the crush strength of the catalyst. A particularly preferred binder for the catalyst of the present invention comprises silica.

The relative proportions of the finely divided crystalline silicate material and the inorganic oxide matrix of the binder can vary widely. Typically, the binder content ranges from 5 to 95% by weight, more typically from 20 to 50% by weight, based on the weight of the composite catalyst. Such a mixture of crystalline silicate and an inorganic oxide binder is referred to as a formulated crystalline silicate.

In mixing the catalyst with a binder, the catalyst may be formulated into pellets, spheres, extruded into other shapes, or formed into a spray-dried powder. For practising the present invention it is preferred that the formulated catalyst has a very symmetrical shape like in spheres and pellets or extrudates having equal height and wideness. It is important that the settling velocity of the catalyst particles in a gas stream is the same for all orientations relative to the gas stream direction.

In the catalytic cracking process, the process conditions are selected in order to provide high selectivity towards propylene, a stable olefin conversion over time, and a stable olefinic product distribution in the effluent. Such objectives are favoured by the use of a low acid density in the catalyst (i.e. a high Si/Al atomic ratio) in conjunction with a low pressure, a high inlet temperature and a short contact time, all of which process parameters are interrelated and provide an overall cumulative effect (e.g. a higher pressure may be offset or compensated by a yet higher inlet temperature). The process conditions are selected to disfavour hydrogen transfer reactions leading to the formation of paraffins, aromatics and coke precursors. The process operating conditions thus employ a high space velocity, a low pressure and a high reaction temperature. The LHSV ranges from 5 to 30 $h^{-1}$, preferably from 10 to 30 $h^{-1}$. The olefin partial pressure ranges from 0.1 to 2 bars, preferably from 0.5 to 1.5 bars. A particularly preferred olefin partial pressure is atmospheric pressure (i.e. 1 bar). The hydrocarbon feedstocks are preferably fed at a total inlet pressure sufficient to convey the feedstocks through the reactor. The hydrocarbon feedstocks may be fed undiluted or diluted in an inert gas, e.g. nitrogen. Preferably, the total absolute pressure in the reactor ranges from 0.5 to 10 bars. The use of a low olefin partial pressure, for example atmospheric pressure, tends to lower the incidence of hydrogen transfer reactions in the cracking process, which in turn reduces the potential for coke formation which tends to reduce catalyst stability. The cracking of the olefins is preferably performed at an inlet temperature of the feedstock of from 500 to 600° C., more preferably from 520 to 600° C., yet more preferably from 540 to 590° C., typically around 560° C. to 585° C.

Embodiments of the present invention will now be described, by way of example only, with reference to the accompanying drawings, in which.

Figure 1:
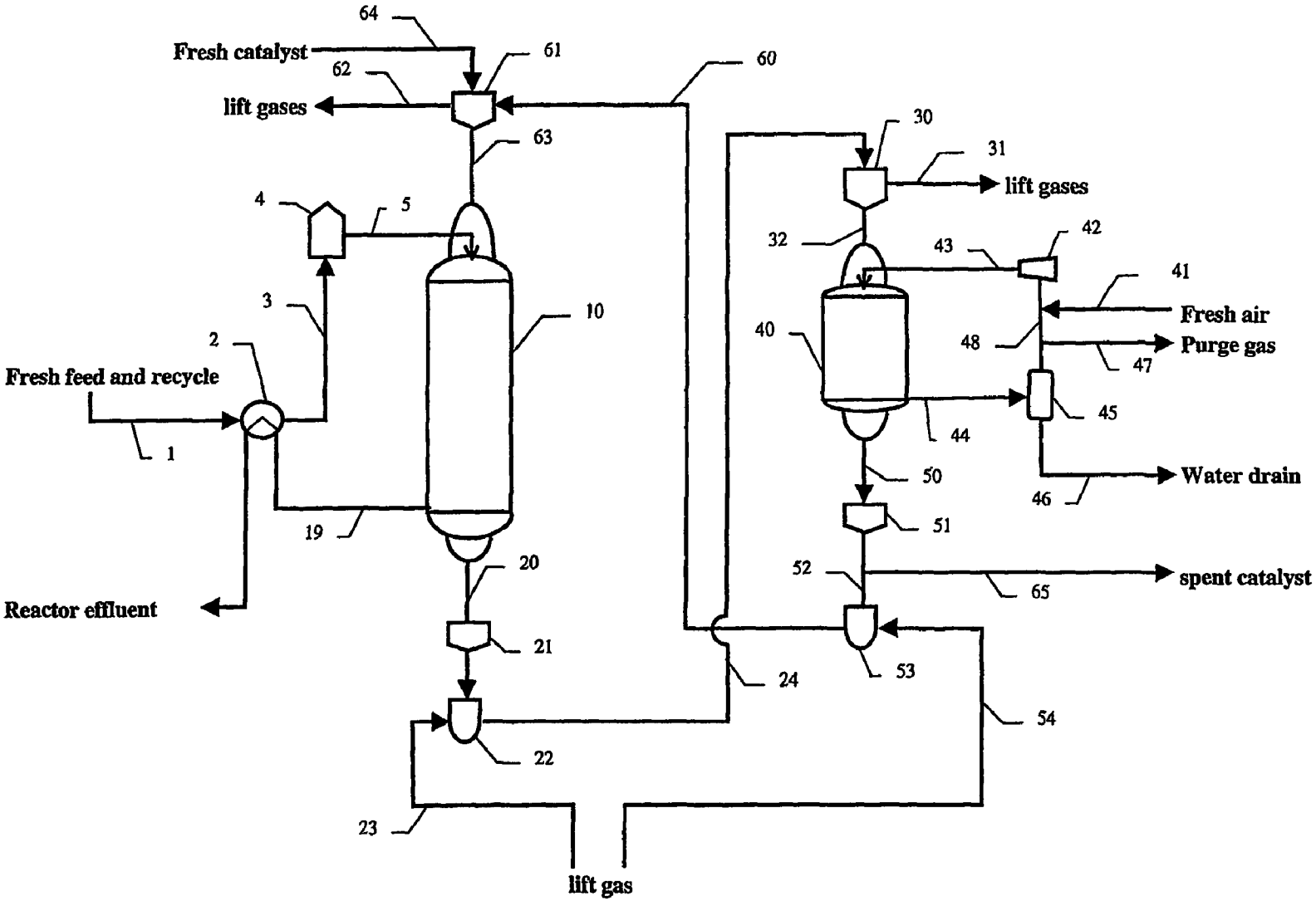
FIG. 1 is a schematic process scheme in accordance with one embodiment of the present invention for processing refinery and/or petrochemical feedstocks, the process scheme incorporating a process for selectively catalytically cracking olefins into lighter olefins over a crystalline silicate catalyst, and incorporating catalyst regeneration.

FIG. 1 provides a schematic illustration of a configuration for practising the process of the present invention. The description is not intended to exclude certain modifications and in order to simplify the drawing shut-off valves, solid flow controlling valves, pumps, piping and other conventional equipment readily known by the person skilled in the art are not shown.

The fresh olefin-containing feed to be catalytically cracked and preferably combined with recycle feed, and optionally a diluting gas like hydrogen, steam or any other inert gas, are sent through line 1 to a feed-effluent heat exchanger 2 and further through line 3 to a heater 4 to raise the temperature of the mixture to the desired reaction temperature. Through line 5 the hot mixture is sent into a radial-flow reactor 10. The reactor 10 contains an annulus of dense phase catalyst. The feed mixture may be injected in the centre of the annulus and may leave the catalyst external to the catalyst bed annulus. Optionally, the feed mixture may be injected in the catalyst bed external to the bed annulus and may leave the catalyst bed annulus in the centre of the annulus. The reaction products leave the reaction section through line 19 via the feed-effluent heat exchanger 2 to the fractionation section (not shown). In the fractionation section the different reaction products are concentrated. Unconverted feed or a produced butene-rich C4 fraction may be recycled together with fresh feed to the reaction section through line 1.

In accordance with the catalyst regeneration in the moving bed reactor in the present invention, the catalyst travels down under gravity through the catalyst bed annulus and is continuously or intermittently withdrawn through line 20 into a lock hopper 21 where the catalyst is purged with nitrogen in order to remove hydrocarbon vapours from the catalyst. In the lock hopper the pressure is equalised to that of a lift engager 22. The catalyst is lifted from the lift engager 22 by means of a lift gas coming through line 23 to a lift dis-engager 30 through a catalyst lift line 24. The gaseous lift gas may be hydrogen, nitrogen, methane, steam or even diluted oxygen in nitrogen. The flow rate of the lift gas is sufficient to surpass the settling velocity of the catalyst particles in order to transfer the catalyst through the lift line 24 to a lift dis-engager 30. In the lift dis-engager 30, the catalyst is separated from the lift gases through line 31 and the pressure is equalised to the pressure of a catalyst regeneration vessel 40. The lift gases may be recycled or sent to other purposes. The catalyst is fed from the lift dis-engager 30 through line 32 to the regeneration vessel 40.

In the regeneration vessel 40 the carbonaceous material laid down on the catalyst is burned off by means of oxygen, to form carbon dioxide. The regeneration vessel 40 may consist of a cylindrical moving bed of catalyst travelling down by gravity. Alternatively, it may also consist of a radial-flow type catalyst bed. The oxidising gases are injected in the centre of the catalyst bed annulus or from the exterior of the annulus. Fresh air is provided through line 41, mixed with recycle gas coming through line 48 and compressed by means of a compressor 42 into line 43. The oxygen containing mixture goes from line 43 into the regeneration vessel 40. The combustion gases leave the regeneration vessel through line 44 and goes to a vessel 45. The combustion gases are cooled down or heat exchanged and eventually dried. Water is drained off through line 46. Uncondensed gases are partially purged out through line 47, and the remaining may be recycled and mixed with fresh air through line 41.

To control the combustion of the carbonaceous material on the catalyst the oxygen should be present at relatively low concentrations. The ratio of recycle gas to fresh air is generally high. The volume percent of oxygen in the oxidising gas is typically from 0.2 to 2, preferably about 0.6. Other compounds may be present in the oxidising gas, such as carbon dioxide, nitrogen and optionally carbon monoxide.

During the regeneration the catalyst travels down under gravity and the carbonaceous material is progressively burned off. It may be desirable to use higher concentrations of oxygen towards the end of the regeneration vessel 40. A second inlet of oxygen containing gas may be injected into the regeneration vessel 40 more to the lower parts of the catalyst bed where carbonaceous material is already burned off to a great extent. As is known, regeneration with oxygen is exothermic and care should be taken not to exceed the temperature at which the catalyst is damaged. It is preferred not to surpass 600° C. in the catalyst bed. The regeneration is generally started at about 450° C. Therefore the oxygen containing gas may be heated up before entering the regeneration vessel 40. The second oxygen containing stream which may be injected into the regeneration vessel may be heated up to a higher temperature to finish better the burn off of carbonaceous materials laid down on the catalyst. The value percent of oxygen in the second oxygen-containing stream is typically from 2 to 100, preferably from 5 to 21. Other compounds may be present in the oxidising gas, such as carbon dioxide, nitrogen and optionally carbon monoxide.

The catalyst flows through line 50 to a lock hopper 51. Optionally, the regeneration may be finished here by purging first the hopper 51 with pure air at the highest allowable temperature for the catalyst, followed by a nitrogen purge in order to remove any remaining oxygen. The catalyst further flows through line 52 to a lift engager 53. By means of a lift gas, coming through line 54, the catalyst is sent to a catalyst collector hopper 61 located above the reactor 10 through a catalyst transfer line 60. The catalyst is separated from the lift gases through line 62. These lift gases may be sent to other purposes or may be recycled and used again as lift gas. The pressure in the catalyst collector hopper 61 is equalised to the reactor pressure. The regenerated catalyst in the collector hopper 61 flows through line 63 into the reactor vessel 10. New fresh catalyst may be added into the catalyst collector hopper 61 through line 64, while used catalyst can be withdrawn from the regeneration system through line 65.

Figure 2:
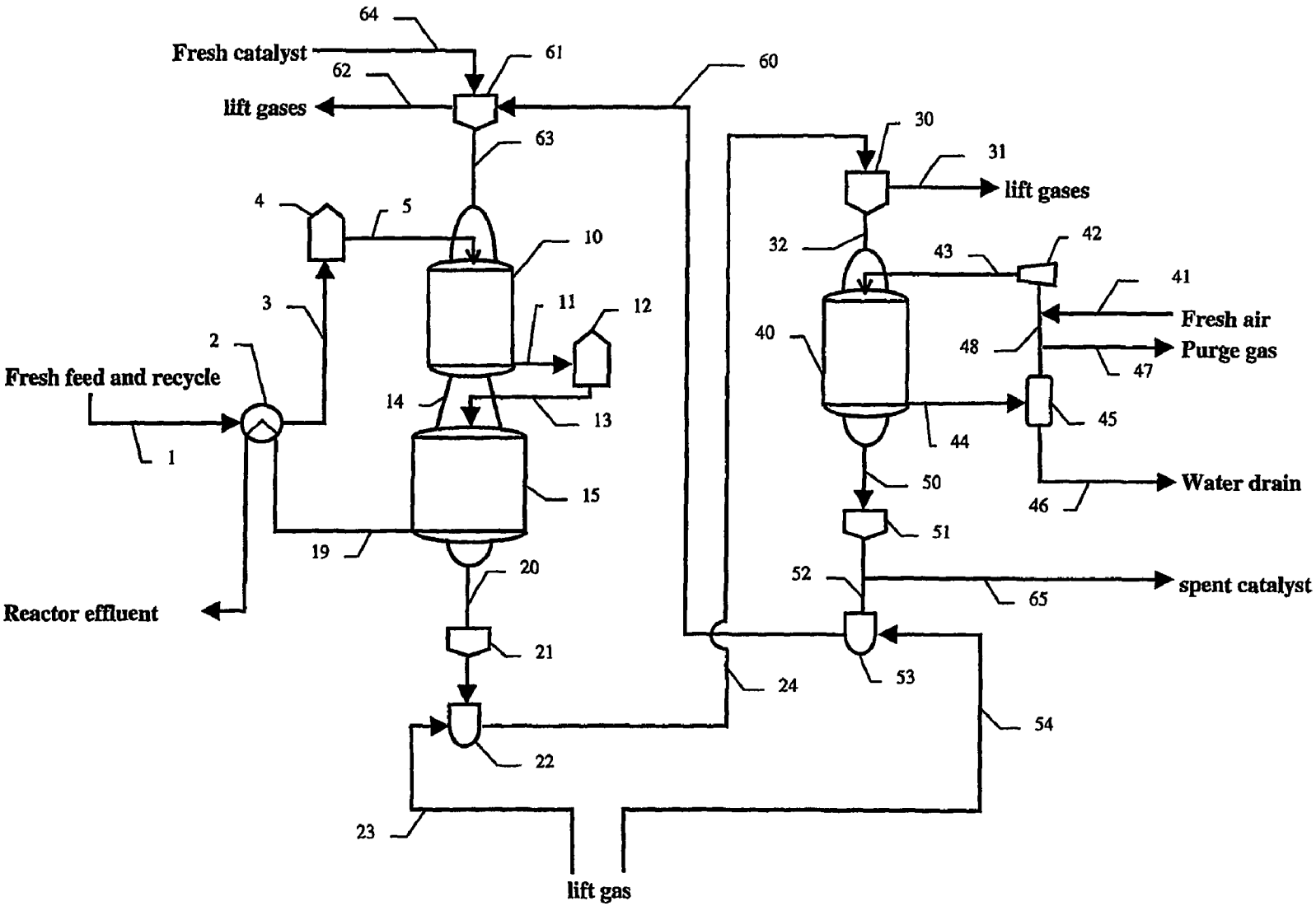
FIG. 2 shows a schematic process scheme in accordance with a second embodiment of the present invention for processing refinery and/or petrochemical feedstocks, the process scheme incorporating a process for selectively catalytic cracking olefins into lighter olefins over a crystalline silicate catalyst and catalyst regeneration.

FIG. 2 shows an alternative embodiment for practising the present invention. As the cracking of long-chain olefins into lighter olefins is an endothermic reaction, it may be desired to reheat the reaction mixture. FIG. 2 shows the alternative embodiment with two moving bed reactors 10, 15 in series for the olefin-cracking process. The reactor effluent of the first radial-flow reactor 10 leaves the reactor through line 11 and is sent to a reheater 12. The mixture is sent through line 13 into the second reactor 15. The second reactor 15 can be located below the first rector 10 as illustrated or optionally the second reactor 15 is parallel to the first reactor 10. In the latter case, there is provided a catalyst lift transfer line (not shown) between the first and the second reactors 10, 15. The rest of the process scheme is as explained above for FIG. 1. As the catalyst becomes less active when moving down through the moving bed, it may be desired to increase the contact time of the reaction mixture with the catalyst in the second reactor. This can easily be done by increasing the thickness of the catalyst bed annulus.

Figure 3:
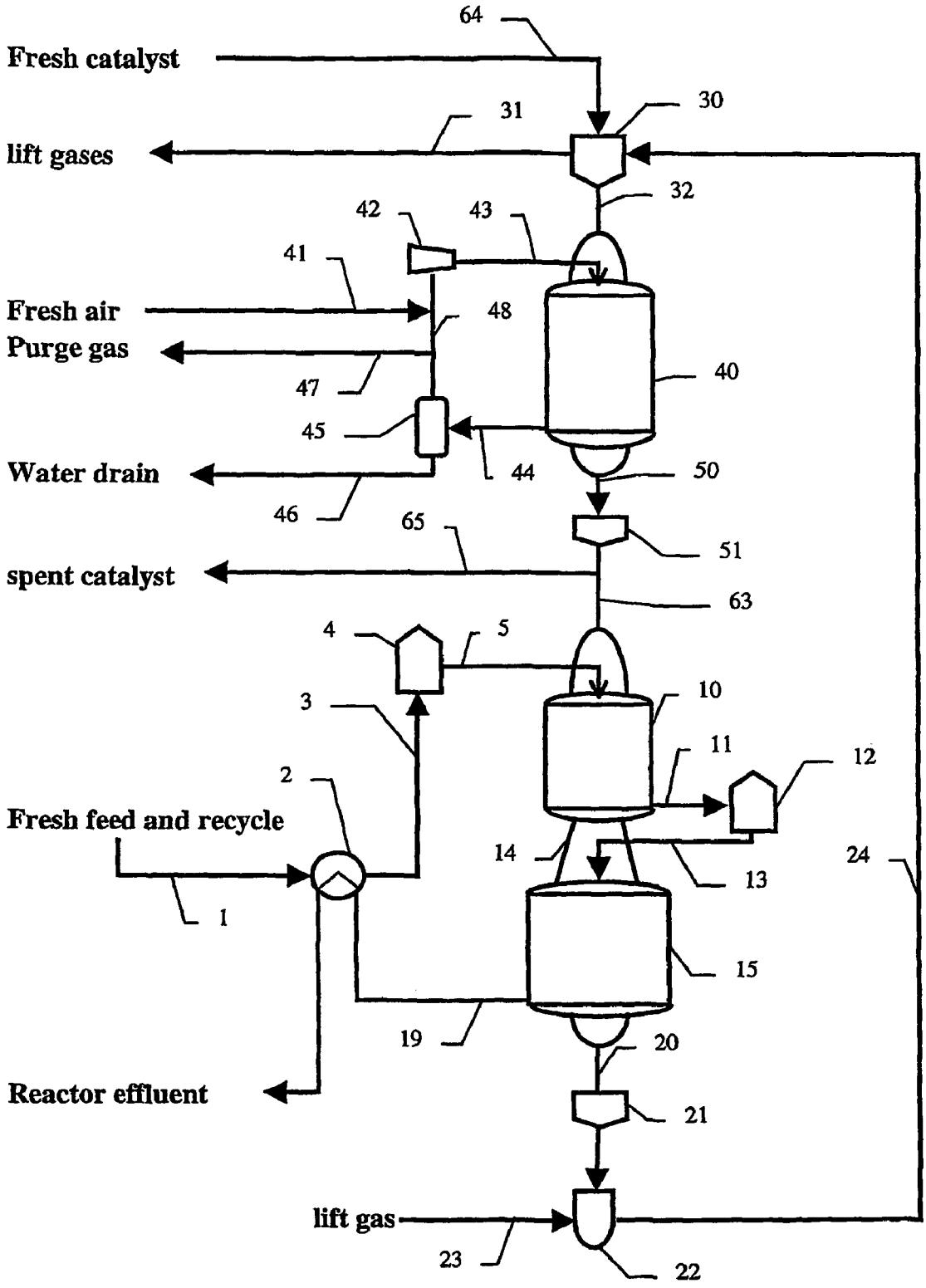
FIG. 3 shows a schematic process scheme in accordance with a third embodiment of the present invention for processing refinery and/or petrochemical feedstocks, the process scheme incorporating a process for selectively catalytically cracking olefins into lighter olefins over a crystalline silicate catalyst and catalyst regeneration.

A still other embodiment for practising the present invention is shown in FIG. 3. As the reactors are not very large, it can be advantageous to place the regeneration vessel 40 on top of the first reactor 10 (or the single reactor 10 as shown in FIG. 1). This implies one fewer catalyst transfer line which will reduce the attrition of the catalyst due to the transport step.

The present invention will now be described with reference to the following non-limiting examples.

EXAMPLE 1

Figure 4:
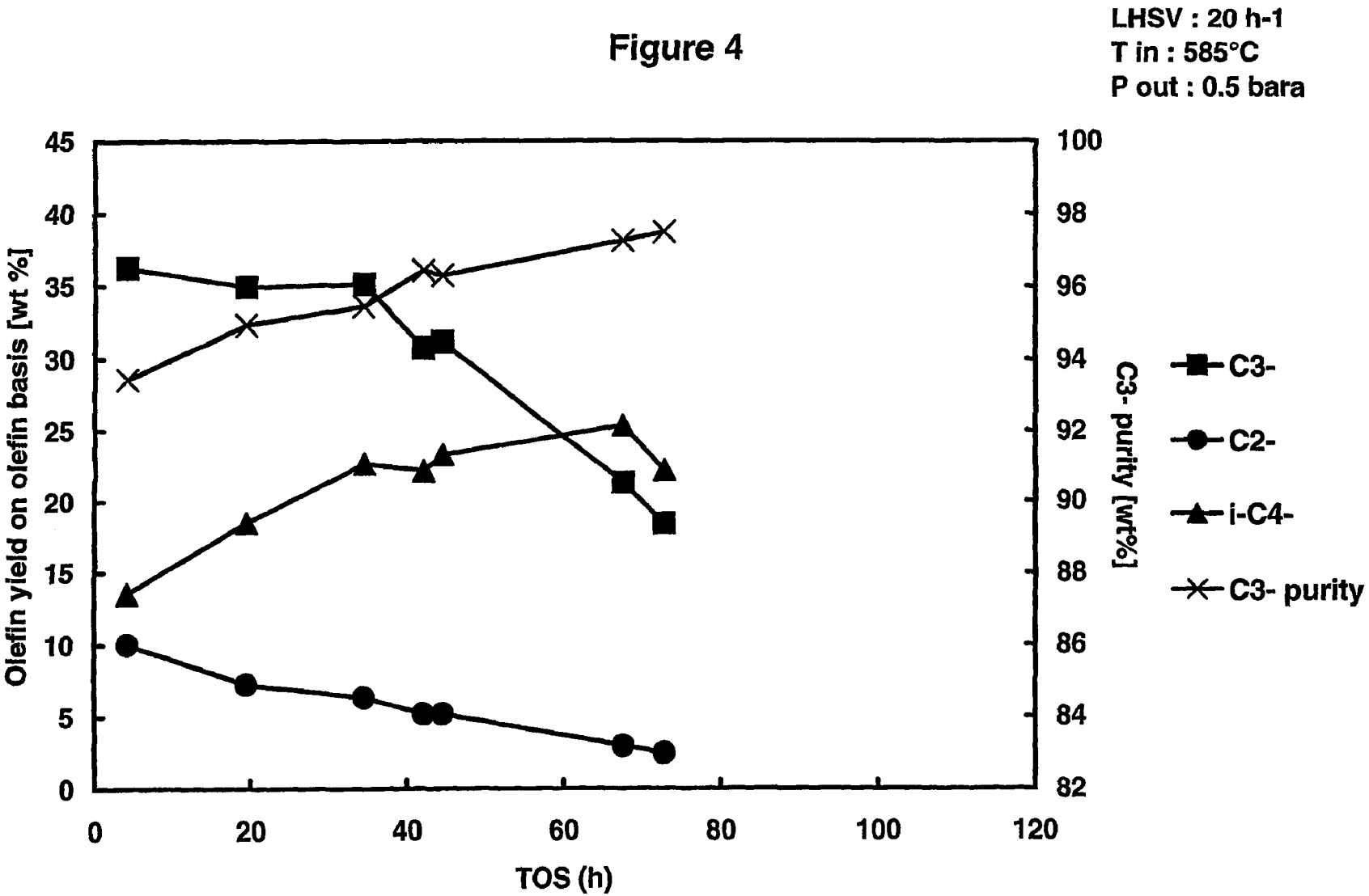
FIG. 4 shows the relationship between the olefin content of an effluent and time for one example of a catalytic cracking process.

A feedstock having the feed composition shown in Table 1, consisting of a 50/50 wt % mixture of $C_4$s and LCCS produced on an FCC unit was subjected to olefin catalytic cracking in a fixed bed reactor (not in accordance with the invention) comprising a crystalline silicate catalyst of the MFI-type (as generally disclosed in EP-A-0921179) having a silicon/aluminium atomic ratio of at least 270 at an inlet temperature of 585° C., a liquid hourly space velocity (LHSV) of 20 $h^{-1}$ and an outlet pressure of 0.5 bara. The composition of the effluent over time was measured to determine the propylene ($C_3$—) content, the ethylene ($C_2$—) content, the isobutene (i-C4-) content and the propylene purity and the results are shown in FIG. 4. The reactor is loaded with 5 liters of catalyst and the reactor operates in an adiabatical mode.

From FIG. 4 it may be seen that the propylene content, i.e. the yield on an olefin basis towards propylene of the olefin-cracking process, is initially slightly greater than or about 35 wt % up to a period of around 35 hours, after which the propylene content rapidly decreases to a value of as low as about 18 wt % after a period of about 75 hours. This shows that the activity of the catalyst towards the production of propylene in the olefin-cracking process reduces over time, specifically for runs greater than around 35 hours. In addition, for shorter reaction times on stream, there are problems in that the ethylene content on an olefin basis of the effluent is initially high, starting from greater than 10 wt % and being greater than 5 wt % up to 40 hours on stream, and also the propylene purity (i.e. the ratio of propylene to total $C_3$ content) is initially low and increases to a value greater than 94 wt % only after a period of around 10 hours on stream.

Table 2 shows values of the propylene content, ethylene content, isobutene content and propylene purity after 4 specific times on stream, up to about 35 hours on stream during which the propylene yield is quite constant.

In accordance with the process of the present invention, by providing a moving bed reactor with continuous catalyst regeneration, the four discrete yields in the effluent are substantially averaged to yield the average values also specified in Table 2. It may thus be seen that by using a moving bed reactor in conjunction with continuous catalyst regeneration, the composition of the effluent may be made more constant, in particular the propylene content and purity. Moreover, the formation of less desired products in the effluent, such as ethylene, which requires a relatively difficult fractionation process to be separated from the desired propylene, reduced continuously to an average acceptable level as compared to the initial level in the case of a fixed bed.

EXAMPLE 2

Figure 5:
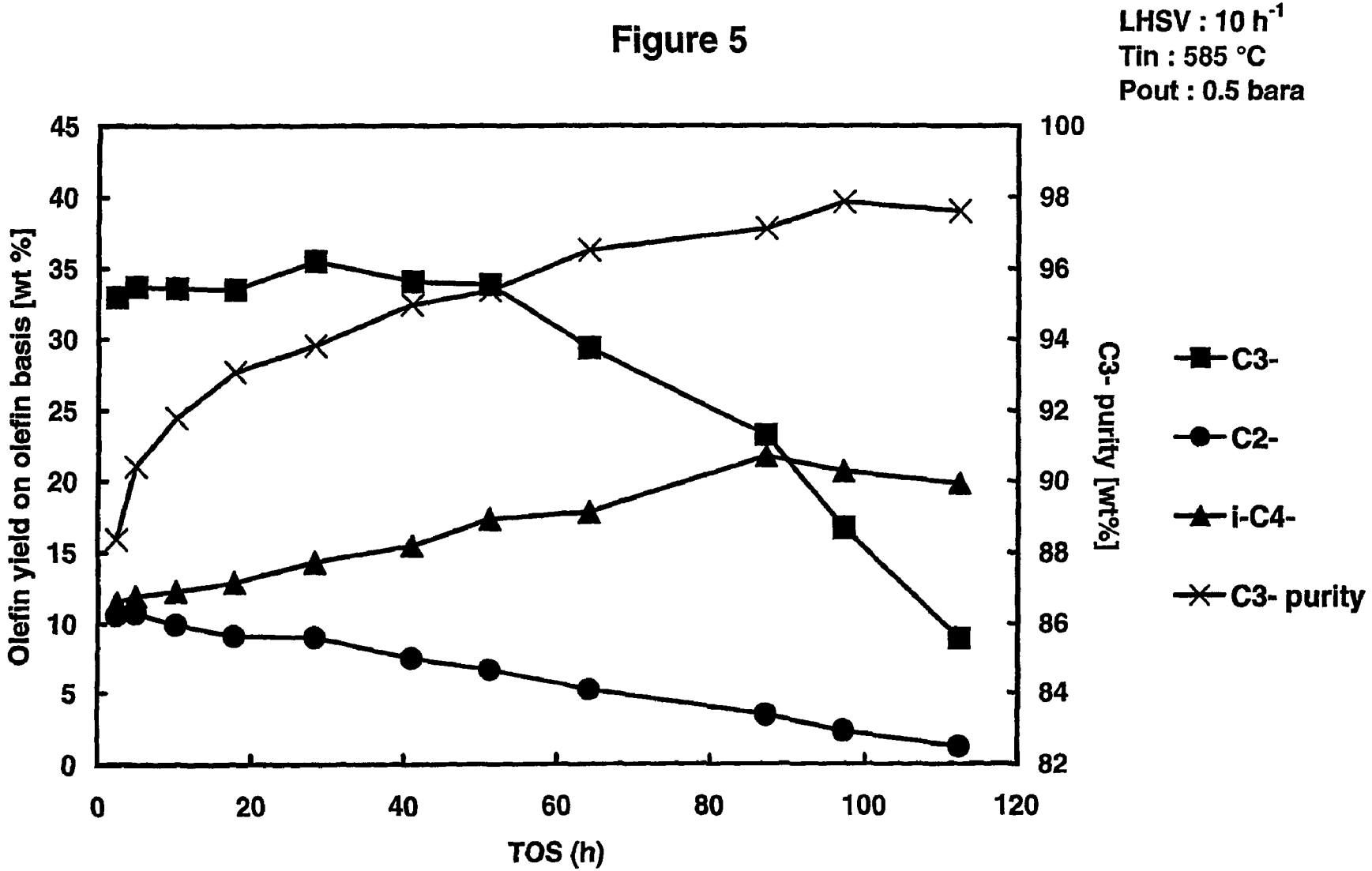
FIG. 5 shows the relationship between olefin content and time for a second example of a catalytic cracking process.

In accordance with this Example, the same feed having a typical composition illustrated in Table 1 was fed over the same catalyst as in Example 1 and at the same inlet temperature and outlet pressure, but at a lower LHSV of 10 $h^{-1}$. The relationship between the olefin content and time on stream is illustrated in FIG. 5. Table 3 shows the variation between the propylene, ethylene and isobutene contents with time, together with the propylene purity variation with time.

As for Example 1, for Example 2 it may be seen that the use of a moving bed reactor together with catalyst regeneration provides a substantially average value for the composition of the effluent which tends to provide an improved average value for the ethylene content and an improved average value for the propylene purity.

TABLE 1

| | FEED COMPOSITION [WT %] | | | | | |
|---|---|---|---|---|---|---|
| C nr | P | O | N | A | Total | Cumulative |
| 1 | | | | | 0.00 | |
| 2 | | | | | 0.00 | 0.00 |
| 3 | 0.02 | 0.28 | | | 0.31 | 0.31 |
| 4 | 17.40 | 25.74 | | | 43.14 | 43.45 |
| 5 | 6.03 | 6.90 | 0.09 | | 13.03 | 56.48 |
| 6 | 8.84 | 5.54 | 1.58 | 0.52 | 16.48 | 72.96 |
| 7 | 3.98 | 3.13 | 2.39 | 3.00 | 12.49 | 85.45 |
| 8 | 3.23 | 1.12 | 2.06 | 3.88 | 10.28 | 95.74 |
| 9 | 1.49 | 0.26 | 0.11 | 1.86 | 3.72 | 99.46 |
| 10 | 0.11 | 0.00 | 0.00 | 0.40 | 0.51 | 99.97 |
| 11 | | | | 0.03 | 0.03 | 100.00 |
| Total | 41.10 | 42.97 | 6.23 | 9.70 | 100.00 | |

TABLE 2

| | EXAMPLE 1 | | | |
|---|---|---|---|---|
| TOS [h] | 4.17 | 19.48 | 34.57 | AVERAGE |
| C3-[wt %] | 36.27 | 34.95 | 35.14 | 35.45 |
| C2-[wt %] | 10.03 | 7.26 | 6.35 | 7.88 |
| i-C4-[wt %] | 13.56 | 18.48 | 22.66 | 18.23 |
| c3-purity [wt %] | 93.44 | 94.94 | 95.45 | 94.61 |

TABLE 3

| | EXAMPLE 2 | | | | | | |
|---|---|---|---|---|---|---|---|
| TOS [h] | 2.47 | 4.92 | 10.18 | 17.83 | 28.37 | 41.10 | AVERAGE |
| C3-[wt %] | 32.93 | 33.71 | 33.61 | 33.49 | 35.53 | 34.09 | 33.89 |
| C2-[wt %] | 10.59 | 10.71 | 9.93 | 9.11 | 9.03 | 7.54 | 9.48 |
| i-C4-[wt %] | 11.51 | 11.96 | 12.31 | 12.93 | 14.34 | 15.47 | 13.09 |

TABLE 3-continued

| | EXAMPLE 2 | | | | | | |
|---|---|---|---|---|---|---|---|
| TOS [h] | 2.47 | 4.92 | 10.18 | 17.83 | 28.37 | 41.10 | AVERAGE |
| c3-purity [wt %] | 88.38 | 90.42 | 91.79 | 93.08 | 93.81 | 94.97 | 92.08 |

The invention claimed is:

1. A process for cracking an olefin-rich hydrocarbon feedstock which is selective towards light olefins in the effluent, the process comprising:

selecting a crystalline silicate catalyst from the group consisting of an MFI-type crystalline silicate having a silicon/aluminum atomic ratio of at least 180 and an MEL-type crystalline silicate having a silicon/aluminum atomic ratio from 150 to 800, wherein said selected catalyst has been subjected to a steaming step;

passing an olefin-rich hydrocarbon feedstock containing one or more olefins through a moving bed reactor containing said selected catalyst at an inlet temperature of from 500° C. to 600° C., an olefin partial pressure of from 0.1 to 2 bars, and a LHSV of from 5 to 30 $h^{-1}$ to produce an effluent containing propylene having an olefin content of a lower molecular weight than an olefin content of the feedstock;

wherein the passing of the olefin-rich hydrocarbon feedstock through the moving bed reactor containing said selected catalyst and the production of the effluent containing propylene, causes concomitant deactivation of said catalyst;

removing a first fraction of the deactivated catalyst from the moving bed reactor and transferring said deactivated catalyst to a regenerator;

regenerating said first fraction of the deactivated catalyst in said regenerator to produce a second fraction of regenerated catalyst and then recycling said second fraction of the regenerated catalyst to the moving bed reactor;

continuing the process of cracking of the olefin rich hydrocarbon feedstock within the reactor and the concurrent deactivation of said catalyst, while continuing to transfer said deactivated catalyst to the regenerator, while also continuing the regeneration of the deactivated catalyst and the recycling of the regenerated catalyst to the moving bed reactor;

maintaining a propylene purity of the effluent from the moving bed reactor at a relatively constant value corresponding to an average value of that observed in a fixed bed reactor using the same feedstock, catalyst, and cracking conditions.

2. The process of claim 1 wherein the catalyst regeneration and recycle rate is controlled to provide an ethylene yield in the effluent having an olefin basis which is less than 10 wt. %.

3. The process of claim 1, wherein the effluent has a propylene purity of at least 94 wt. % based upon a total $C_3$ content of the effluent.

4. The process of claim 1, wherein the olefin content of the effluent is within +15 wt. % of the olefin content of the feedstock.

5. The process of claim 1, wherein said first fraction of the catalyst is intermittently removed from said moving bed reactor.

6. The process of claim 5, wherein said second fraction of the regenerated catalyst is intermittently supplied from said regenerator to said moving bed reactor.

7. The process of claim 1, wherein said catalyst is regenerated in said regenerator by supplying an oxidizing gas containing oxygen in amount within the range of 0.2 to 2 vol. %.

8. The method of claim 1, wherein the regeneration of the catalyst in said regenerator involves supplying an initial oxygen-containing gas to the regenerator and supplying a second oxygen-containing gas to the regenerator at a point downstream of the supply of said initial oxygen-containing gas, said second oxygen-containing gas having a higher oxygen content than said initial oxygen-containing gas.

9. The process of claim 8, wherein said second oxygen-containing gas contains from 5 to 21 vol. % oxygen.

10. The process of claim 1, wherein said moving bed reactor comprises a first stage reactor and a second stage reactor connected in series with said first stage reactor, wherein the effluent from the first stage reactor is heated and then supplied to an inlet of said second stage reactor.

11. The process of claim 10, wherein the contact time of the reaction mixture with the catalyst in the second stage reactor is greater than the contact time of the reaction mixture with the catalyst in the first stage reactor.

12. A process for cracking an olefin-rich hydrocarbon feedstock which is selective towards light olefins in the effluent, the process comprising:

passing a hydrocarbon feedstock containing one or more olefins through a moving bed reactor containing a crystalline silicate catalyst, with concomitant deactivation of said catalyst, at an inlet temperature of from 500 to 600 0° C., at an olefin partial pressure of from 0.1 to 2 bars, and a LHSV of from 5 to 30 $h^{-1}$ to produce an effluent with an olefin content of lower molecular weight than that of the feedstock;

wherein said moving bed reactor comprises a first stage reactor and a second stage reactor connected in series with said first stage reactor, and wherein the effluent from the first stage reactor is heated and then supplied to an inlet of said second stage reactor;

wherein said crystalline silicate catalyst is selected from an MFI-type crystalline silicate having a silicon/aluminum atomic ratio of at least 180 and an MEL-type crystalline silicate having a silicon/aluminum atomic ratio from 150 to 800 which has been subjected to steaming step;

removing a first fraction of the deactivated catalyst from the moving bed reactor and transferring said deactivated catalyst to a regenerator;

regenerating said deactivated catalyst in said regenerator to produce a second fraction of regenerated catalyst, then recycling said regenerated catalyst to the moving bed reactor;

continuing the transfer of deactivated catalyst and the recycle of regenerated catalyst while carrying out the cracking of the olefin-rich hydrocarbon feedstock to regenerate all of the catalyst in the moving bed reactor at a rate of from 20 to 240 hours; and wherein a propylene purity in the effluent produced by the moving bed reactor is maintained at a relative constant value corresponding to an average value of that obtained in a fixed bed reactor using the same feedstock, catalyst, and cracking conditions.

13. The process of claim 12, wherein a regeneration and recycle rate is controlled to have an ethylene yield on an olefin basis which is less than 10 wt. %.

14. The process of claim 12, wherein a propylene yield of said process is within the range of 30 to 50 wt. % propylene with a selectivity to propylene of at least 92 wt. % of a total amount of propylene and propane in the effluent.

15. The process of claim 14, wherein the olefin content of the effluent is within the range of +10 wt. % of the olefin content of the feedstock.

16. The method of claim 12, wherein the catalyst is regenerated in said regenerator by supplying a initial oxygen-containing gas to the regenerator and supplying a second oxygen-containing gas to the regenerator at a point downstream of the introduction of said initial oxygen-containing gas, said second oxygen-containing gas having a higher oxygen content than said initial oxygen-containing gas.

17. The process of claim 16, wherein said second oxygen-containing gas contains from 5 to 21 vol. % oxygen.

18. The process of claim 12, wherein a contact time of the feedstock with the catalyst in the second stage reactor is greater than a contact time of the feedstock with the catalyst in the first stage reactor.

19. A process for cracking an olefin-rich hydrocarbon feed stock which is selective towards light olefins in the effluent the process comprising:

passing a hydrocarbon feedstock containing one or more olefins through a moving bed reactor containing a crystalline silicate catalyst to produce an effluent with an olefin content of lower molecular weight than that of the feedstock with concomittant deactivation of said catalyst;

removing the deactivated catalyst from the moving bed reactor and regenerating said deactivated catalyst to produce a regenerated catalyst which is recycled to said moving bed reactor;

continuing the removal of the deactivated catalyst and the recycling of the regenerated catalyst while continuing to crack the olefin-rich hydrocarbon feedstock, while continuing the regeneration of the deactivated catalyst and while continuing the recycling of the regenerated catalyst to the moving bed reactor;

maintaining the propylene purity of the effluent produced by the moving bed reactor at a constant value corresponding to an initial value of that observed in an effluent from a fixed bed reactor during an initial period of an olefin cracking process using the same feedstock, catalyst, and cracking conditions.

20. The process of claim 19, wherein the catalyst removal and regeneration in the moving bed is employed so as to average a propylene purity to higher values observed in a fixed bed reactor in an initial 10 to 40 hours period of said olefin-cracking process.

21. The process according to claim 19, wherein said moving bed reactor comprises a first stage reactor and a second stage reactor connected in series with said first stage reactor, wherein the effluent from the first stage reactor is heated and then supplied to the inlet of said second stage reactor.

22. The process of claim 21, wherein the contact time of the reaction mixture with the catalyst in the second reactor is greater than the contact time of the reaction mixture with the catalyst in the first stage reactor.

23. The process of claim 19, wherein fresh makeup catalyst is supplied to said moving bed reactor along with said regenerated catalyst recycled to said moving bed reactor.

24. The process of claim 19, wherein the catalyst regeneration and recycle is controlled to provide an average ethylene yield which is larger than the high ethylene yield during the initial period and the low ethylene yield during the final period observed in said fixed bed reactor.

* * * * *